US011920849B1

(12) United States Patent
Green

(10) Patent No.: US 11,920,849 B1
(45) Date of Patent: Mar. 5, 2024

(54) COMBINED ICE CHEST AND BAR TOP

(71) Applicant: Freddie Green, Charleston, SC (US)

(72) Inventor: Freddie Green, Charleston, SC (US)

( * ) Notice: Subject to any disclaimer, the term of this patent is extended or adjusted under 35 U.S.C. 154(b) by 385 days.

(21) Appl. No.: 17/373,844

(22) Filed: Jul. 13, 2021

(51) Int. Cl.
*A47B 31/00* (2006.01)
*F25D 13/00* (2006.01)
*F25D 23/12* (2006.01)

(52) U.S. Cl.
CPC ..... *F25D 13/00* (2013.01); *A47B 31/00* (2013.01); *F25D 23/12* (2013.01); *A47B 2031/002* (2013.01)

(58) Field of Classification Search
CPC ..... F25D 13/00; F25D 23/12; A47B 31/00; A47B 2031/002; A47B 2031/008; A47B 2031/026
USPC ..... 280/47.34
See application file for complete search history.

(56) References Cited

U.S. PATENT DOCUMENTS 929,689 A 8/1909 Mullikin
1,095,239 A * 5/1914 Strandberg ..... A47B 11/00 108/20
1,118,851 A * 11/1914 Turner ..... A47B 11/00 108/142
4,060,038 A * 11/1977 Ruvolo ..... A47B 11/00 108/104
4,876,969 A * 10/1989 Infanti ..... A47B 31/00 108/23
5,269,157 A 12/1993 Ciminelli
5,285,656 A 2/1994 Peters
5,306,029 A 4/1994 Kaiser
D370,159 S 5/1996 Fenton
5,937,764 A * 8/1999 Olivier ..... A47B 11/00 108/20
7,908,977 B2 * 3/2011 Zak ..... A47B 31/02 108/26
9,232,290 B2 1/2016 Besay
9,623,318 B2 * 4/2017 Yang ..... A47B 97/00
11,686,428 B2 * 6/2023 Ben-Avi ..... B25G 1/04 248/558
2004/0026998 A1 * 2/2004 Henriott ..... B60N 3/14 307/9.1
2008/0031483 A1 2/2008 Hill
2009/0101046 A1 * 4/2009 Zak ..... A47B 31/02 108/14

(Continued)

FOREIGN PATENT DOCUMENTS

EP 2055206 4/2013

*Primary Examiner* — James A Shriver, II
*Assistant Examiner* — Hilary L Johns
(74) *Attorney, Agent, or Firm* — Kyle A. Fletcher, Esq.

(57) ABSTRACT

The combined ice chest and bar top forms a temporary station from which the one or more beverages can be prepared and distributed. The combined ice chest and bar top incorporates a pedestal structure, a storage platform, a storage stanchion, and a service platform. The storage platform attaches the pedestal structure to the storage stanchion. The storage stanchion attaches the service platform to the storage platform. The pedestal structure is the inferior structure of the combined ice chest and bar top. The pedestal structure forms the cart structure that allows the combined ice chest and bar top to be rolled into position. The pedestal structure further adjusts the elevation of the storage platform, the storage stanchion, and the service platform relative to a supporting surface.

13 Claims, 3 Drawing Sheets

(56) References Cited

U.S. PATENT DOCUMENTS

| | | | | |
|---|---|---|---|---|
| 2014/0265190 | A1* | 9/2014 | Beaver | B62B 1/125 280/47.26 |
| 2015/0166089 | A1* | 6/2015 | Rupp | A23G 9/22 280/651 |
| 2016/0046416 | A1* | 2/2016 | Gao | B65D 81/3813 220/592.09 |
| 2021/0284215 | A1* | 9/2021 | Lindsey | B62B 3/02 |

* cited by examiner

COMBINED ICE CHEST AND BAR TOP

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of service wagons. (A47B31/00)

SUMMARY OF INVENTION

The combined ice chest and bar top is a service wagon. The combined ice chest and bar top is a cart. The combined ice chest and bar top is adapted for use in transporting and servicing one or more beverages. The combined ice chest and bar top forms a temporary station from which the one or more beverages can be prepared and distributed.

The combined ice chest and bar top comprises a pedestal structure, a storage platform, a storage stanchion, and a service platform. The storage platform attaches the pedestal structure to the storage stanchion. The storage stanchion attaches the service platform to the storage platform. The one or more beverages are prepared from ingredients on a workspace formed by the service platform. The storage stanchion and the storage platform contain the ingredients required to prepare the one or more beverages. The pedestal structure is the inferior structure of the combined ice chest and bar top. The pedestal structure forms the cart structure that allows the combined ice chest and bar top to be rolled into position. The pedestal structure further adjusts the elevation of the storage platform, the storage stanchion, and the service platform relative to the supporting surface.

These together with additional objects, features and advantages of the combined ice chest and bar top will be readily apparent to those of ordinary skill in the art upon reading the following detailed description of the presently preferred, but nonetheless illustrative, embodiments when taken in conjunction with the accompanying drawings.

In this respect, before explaining the current embodiments of the combined ice chest and bar top in detail, it is to be understood that the combined ice chest and bar top is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the combined ice chest and bar top.

It is therefore important that the claims be regarded as including such equivalent construction insofar as they do not depart from the spirit and scope of the combined ice chest and bar top. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
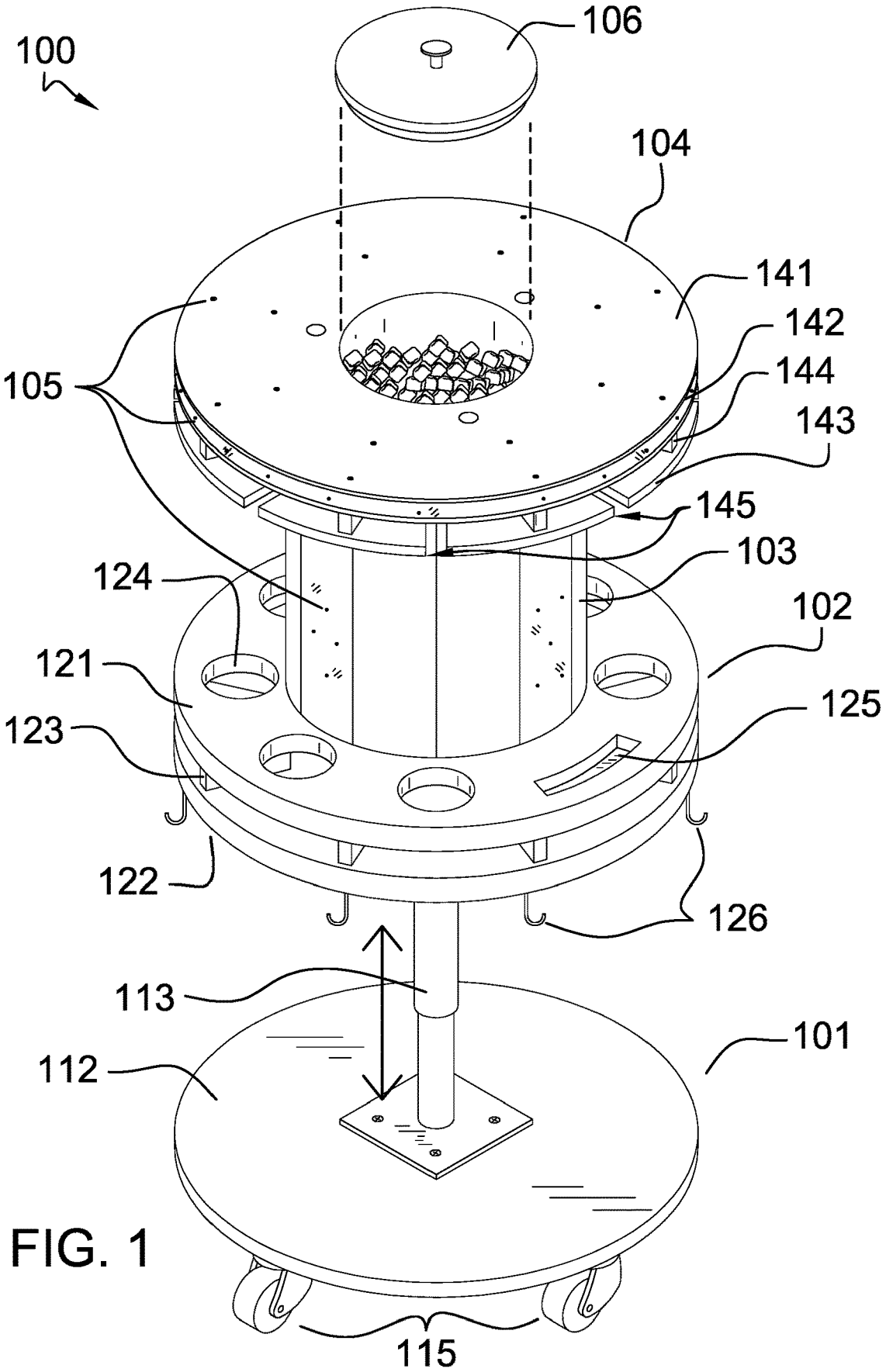
FIG. 1 is a perspective view of an embodiment of the disclosure.
Figure 2:
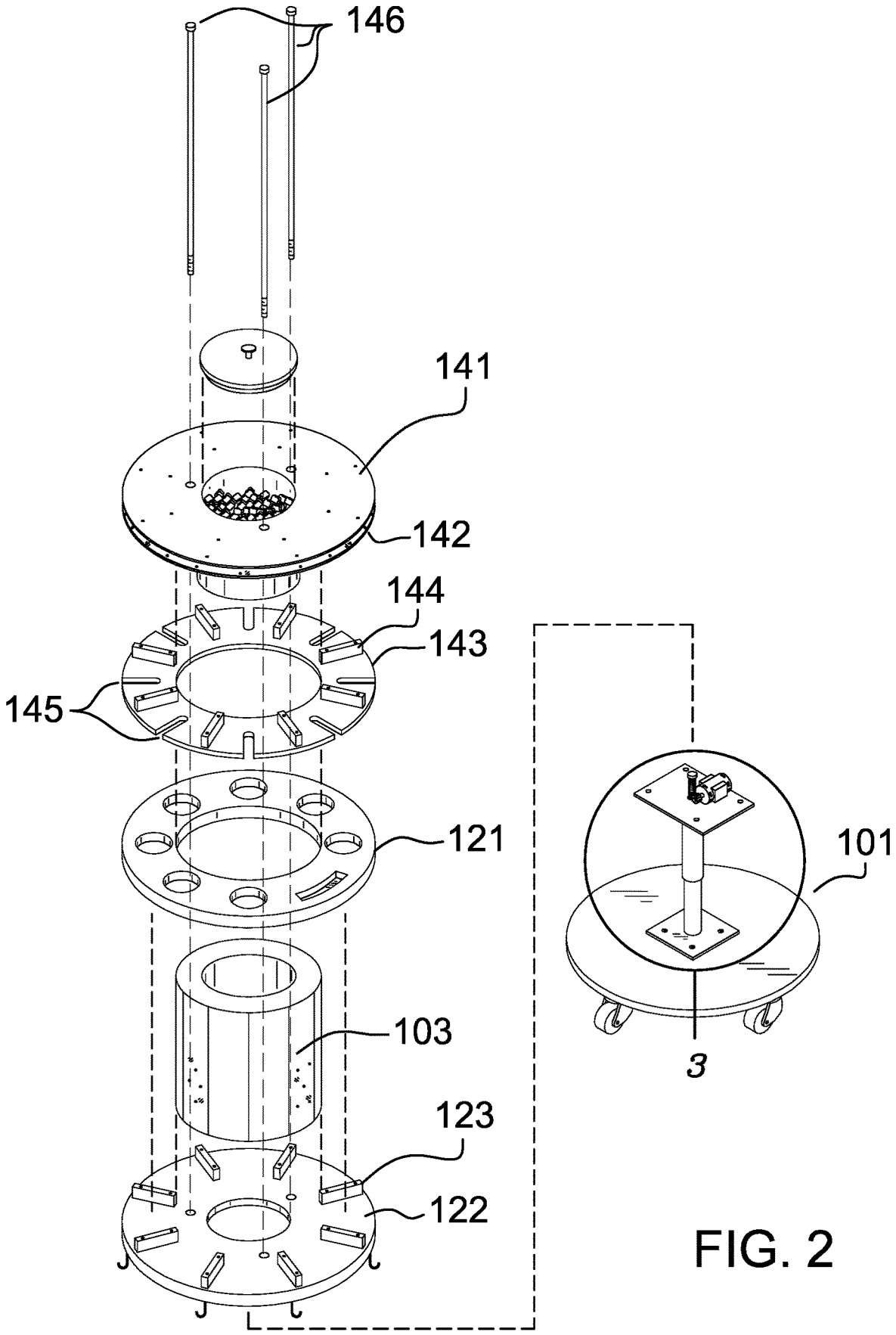
FIG. 2 is an exploded view of an embodiment of the disclosure.
Figure 3:
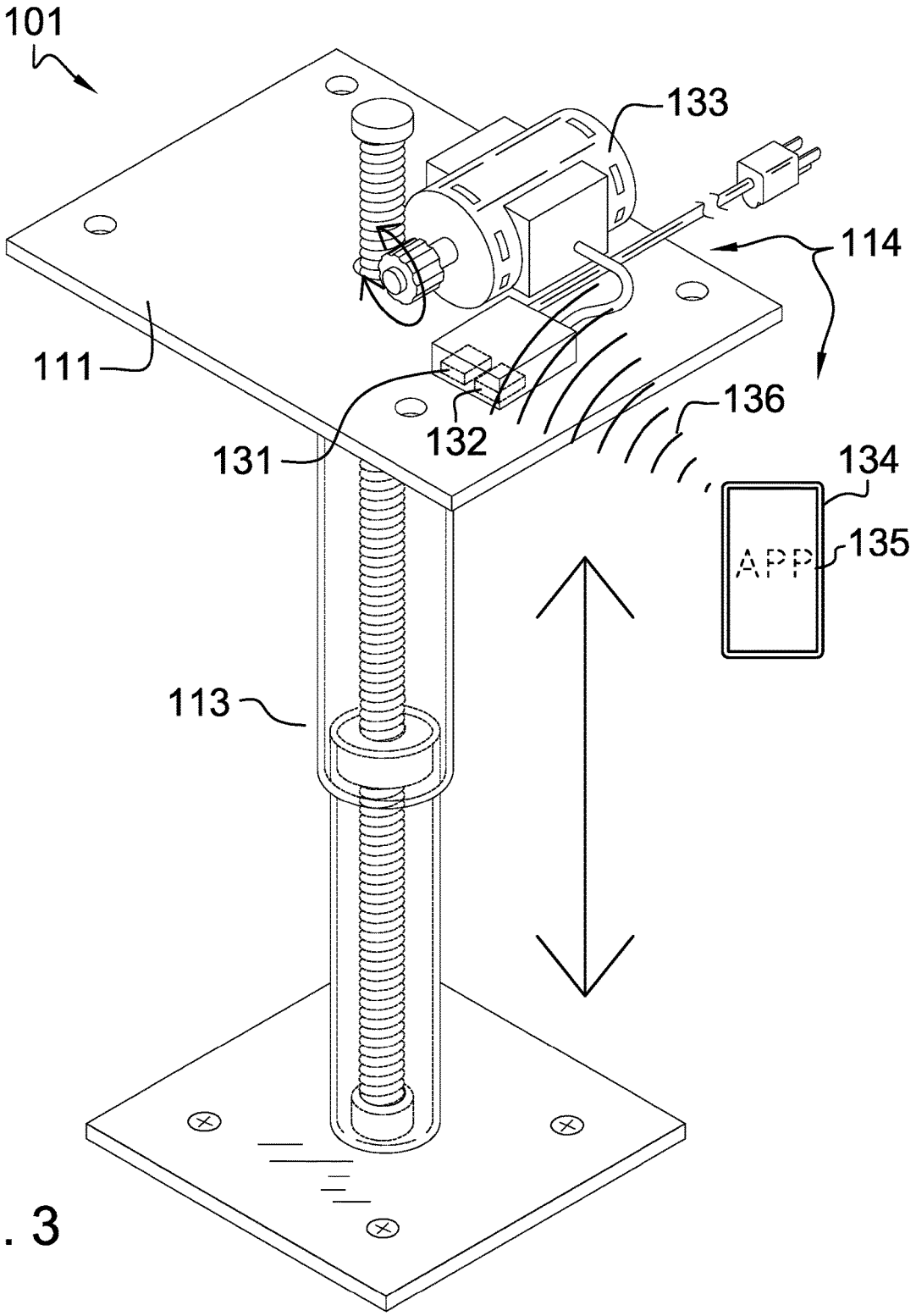
FIG. 3 is a detail view of an embodiment of the disclosure.

Detailed reference will now be made to one or more potential embodiments of the disclosure, which are illustrated in FIGS. 1 through 3.

The combined ice chest and bar top 100 (hereinafter invention) is a service wagon. The invention 100 is a cart. The invention 100 is adapted for use in transporting and servicing one or more beverages. The invention 100 forms a temporary station from which the one or more beverages can be prepared and distributed.

The invention 100 comprises a pedestal structure 101, a storage platform 102, a storage stanchion 103, and a service platform 104. The storage platform 102 attaches the pedestal structure 101 to the storage stanchion 103. The storage stanchion 103 attaches the service platform 104 to the storage platform 102. The one or more beverages are prepared from ingredients on a workspace formed by the service platform 104. The storage stanchion 103 and the storage platform 102 contain the ingredients required to prepare the one or more beverages. The pedestal structure 101 is the inferior structure of the invention 100. The pedestal structure 101 forms the cart structure that allows the invention 100 to be rolled into position. The pedestal structure 101 further adjusts the elevation of the storage platform 102, the storage stanchion 103, and the service platform 104 relative to a supporting surface.

The pedestal structure 101 forms the inferior structure of the invention 100. The pedestal structure 101 has a composite prism structure. The pedestal structure 101 forms a load path that transfers the load of the invention 100 to a supporting surface. The pedestal structure 101 is a rolling structure. The pedestal structure 101 forms a cart that transports the invention 100 to a temporary location. The pedestal structure 101 is an extension device. The pedestal structure 101 is an adjustable structure. By adjustable is meant that the vertical reach of the pedestal structure 101 is adjustable such that the elevations of the storage platform 102, the storage stanchion 103, and the service platform 104 relative to the supporting surface. The pedestal structure 101 comprises a superior pedestal plate 111, an inferior pedestal plate 112, a worm drive 113, and a control circuit 114.

The superior pedestal plate 111 is a prism shaped structure. The superior pedestal plate 111 is a disk shaped structure. The superior pedestal plate 111 forms the superior structure of the pedestal structure 101.

The inferior pedestal plate 112 is a prism shaped structure. The inferior pedestal plate 112 is a disk shaped structure. The inferior pedestal plate 112 forms the load path of the structure that transfers the load of the invention 100 from the worm drive 113 to the plurality of casters 115. The inferior pedestal plate 112 further comprises a plurality of casters 115. Each of the plurality of casters 115 is a caster. Each of the plurality of casters 115 mounts to the inferior surface of the inferior storage plate 122. The plurality of casters 115 forms the final link of the load path that transfers the load of the invention 100 to the supporting surface. Each of the plurality of casters 115 forms a rolling structure that allows the invention 100 to be rolled to its temporary position.

The worm drive 113 is a mechanical device that attaches the superior pedestal plate 111 to the inferior pedestal plate 112. The worm drive 113 is defined elsewhere in this disclosure. The worm drive 113 attaches the superior pedestal plate 111 to the inferior pedestal plate 112 such that the faces of the disk structures of the superior pedestal plate 111 and the inferior pedestal plate 112 are parallel to each other. The worm drive 113 has a prism shape. The worm drive 113 attaches the superior pedestal plate 111 to the inferior pedestal plate 112 to form a composite prism structure. The worm drive 113 is an adjustable structure. By adjustable is meant that the vertical reach of the worm drive 113 is adjustable such that the reach between the superior pedestal plate 111 and the inferior pedestal plate 112 is adjustable.

The control circuit 114 is an electric circuit. The control circuit 114 controls the operation of the worm drive 113. The control circuit 114 provides the motive forces necessary to power the worm drive 113. The control circuit 114 comprises a logic module 131, a communication module 132, an electric motor 133, and a personal data device 134. The logic module 131, the communication module 132, and the electric motor 133 are electrically interconnected connected. The communication module 132 further comprises a wireless communication link 136. The communication module 132 forms the wireless communication link 136 with the personal data device 134. The personal data device 134 further comprises an application 135.

The logic module 131 is a programmable electronic device that is used to manage, regulate, and operate the control circuit 114. The communication module 132 is a wireless electronic communication device that allows the logic module 131 to wirelessly communicate with a personal data device 134. Specifically, the communication module 132 establishes a wireless communication link 136 between the control circuit 114 and the personal data device 134. In the first potential embodiment of the disclosure the communication module 132 supports a communication protocol selected from the group consisting of a WiFi™ protocol or a Bluetooth™ protocol.

The personal data device 134 is a programmable electrical device. The personal data device 134 further comprises an application 135. The personal data device 134 provides data management and communication services through one or more functions referred to as an application 135. The application 135 is a set of logical operating instructions that are performed by the personal data device 134. The addition of an application 135 will provide increased functionality for the personal data device 134. This disclosure assumes that an application 135 exists for the purpose of interacting with the invention 100. Methods to design and implement an application 135 on a personal data device 134 are well known and documented in the electrical arts.

The application 135 of the personal data device 134 forms an interface between the control circuit 114 and a client using the invention 100. The personal data device 134 transmits operating instructions regarding the elevation of the service platform 104 over the wireless communication link 136 to the control circuit 114. The communication module 132 receives the transmitted operating instructions and relays the received operating instructions to the logic module 131.

The personal data device 134 transmits instructions regarding the desired elevation of the service platform 104 of the invention 100 to the communication module 132 through the wireless communication link 136. The communication module 132 transmits the received instructions to the logic module 131.

The logic module 131 controls the operation of the electric motor 133. The electric motor 133 is an electromechanical device. The electric motor 133 converts electrical energy into rotational mechanical energy. The electric motor 133 forms a mechanical linkage with the worm drive 113 of the pedestal structure 101 such that the rotation of the electric motor 133 provides the motive forces required for the operation of the worm drive 113. The logic module 131 controls the operation of the electric motor 133. By controlling the operation of the logic module 131 is meant that the logic module 131 controls the direction of rotation of the electric motor 133. By controlling the operation of the logic module 131 is further meant that the logic module 131 controls the speed of rotation of the electric motor 133.

The storage platform 102 is a prism shaped structure. The storage platform 102 has a composite prism structure. The storage platform 102 forms a storage structure. The superior pedestal plate 111 of the pedestal structure 101 attaches to the inferior congruent end of the storage platform 102 to form a composite prism structure. The storage platform 102 comprises a superior storage plate 121, an inferior storage plate 122, and a plurality of storage spacers 123.

The superior storage plate 121 is a prism shaped structure. The superior storage plate 121 is a disk shaped structure. The superior storage plate 121 has a ring shape. The superior storage plate 121 forms the superior structure of the storage platform 102. The inner diameter of the negative space that forms the characteristic ring structure of the of the superior storage plate 121 is sized such that the storage stanchion 103 inserts through the superior storage plate 121 to rest on the superior surface of the inferior storage plate 122.

The inferior storage plate 122 is a prism shaped structure. The inferior storage plate 122 is a disk shaped structure. The inferior storage plate 122 forms the inferior structure of the storage platform 102. The superior end of the worm drive 113 of the pedestal structure 101 attaches to the inferior congruent end of the disk structure of the inferior storage plate 122 such that the vertical movement of the worm drive 113 changes the elevation of the inferior storage plate 122. The closed end of the pan structure of the storage stanchion 103 inserts through the negative space that forms the characteristic ring structure of the superior storage plate 121 and the plurality of storage spacers 123 to rest on the superior surface of the inferior storage plate 122. The inferior storage plate 122 comprises a plurality of bottle recesses 124, a personal data device 134 recess 125, and a plurality of hooks 126.

Each of the plurality of bottle recesses 124 is a recess that is formed in the superior surface of the inferior storage plate 122. Each of the plurality of bottle recesses 124 is sized to receive and store a bottle within the storage platform 102. The personal data device 134 recess 125 is a recess that is formed in the superior surface of the inferior storage plate 122. The personal data device 134 recess 125 is sized to receive and store the personal data device 134 in the storage platform 102. Each of the plurality of hooks 126 is a hook that attaches to the inferior surface of the inferior storage plate 122. Each of the plurality of hooks 126 forms a structure from which an object is suspended.

The plurality of storage spacers 123 forms and extension structure. Each of the plurality of storage spacers 123 attaches the inferior face of the superior storage plate 121 to the superior face of the inferior storage plate 122 such that the plurality of storage spacers 123 forms a space between the superior storage plate 121 and the inferior storage plate 122. The plurality of storage spacers 123 positions the superior storage plate 121 relative to the inferior storage plate 122 such that the center axes of the superior storage plate 121 and the inferior storage plate 122 align. The plurality of storage spacers 123 are positioned such that: a) the superior storage plate 121 and the inferior storage plate 122 attach to the lateral faces of the plurality of storage spacers 123; and, b) that the center axes of the plurality of storage spacers 123 project radially away from the aligned center axes of the superior storage plate 121 and the inferior storage plate 122.

The storage stanchion 103 inserts into the superior congruent end of the storage platform 102 to form a composite prism structure. The storage stanchion 103 is a prism shaped structure. The storage stanchion 103 has a pan shape. The storage stanchion 103 forms a hollow interior used to store ice. The storage stanchion 103 is an insulating structure. The open face of the pan structure of the storage stanchion 103 forms the superior surface of the storage stanchion 103.

The service platform 104 forms the inferior structure of the invention 100. The service platform 104 has a composite prism structure. The service platform 104 attaches to the open face of the pan structure of the storage stanchion 103 to form the composite prism structure. The superior service of the service platform 104 forms a work surface. The service platform 104 comprises a superior service plate 141, a medial service plate 142, and an inferior service plate 143.

The superior service plate 141 is a prism shaped structure. The superior service plate 141 is a disk shaped structure. The superior service plate 141 has a ring shape. The negative space that forms the characteristic ring structure of the superior service plate 141 is geometrically similar to the storage stanchion 103. The negative space that forms the characteristic ring structure of the superior service plate 141 is a disk shaped structure. The center axis of the negative space that forms the characteristic ring structure of the of the superior service plate 141 aligns with the center axis of the storage stanchion 103 such that the open face of the pan structure of the storage stanchion 103 is accessible through the superior service plate 141. The superior service plate 141 further comprises a plurality of anchors 146.

Each of the plurality of anchors 146 is a prism shaped structure. The plurality of anchors 146 secures the storage stanchion 103 to the service platform 104 such that the service platform 104 remains in a fixed position relative to the storage stanchion 103.

The medial service plate 142 is a prism shaped structure. The medial service plate 142 of the medial service plate 142 is a disk shaped structure. The medial service plate 142 has a ring shape. The inner diameter of the negative space that forms the characteristic ring structure of the medial service plate 142 is sized such that the storage stanchion 103 inserts through the medial service plate 142 to reach the superior service plate 141.

The superior surface of the medial service plate 142 mounts directly onto the inferior surface of the superior service plate 141. The medial service plate 142 mounts on the superior service plate 141 such that the center axes of the medial service plate 142 and the superior service plate 141 align. The medial service plate 142 mounts on the superior service plate 141 such that the center axis of the negative space that forms the characteristic ring structure of the of the medial service plate 142 aligns with the center axis of the negative space that forms the characteristic ring structure of the of the inferior service plate 143 is a prism shaped structure.

The inferior service plate 143 is a prism shaped structure. The inferior service plate 143 is a disk shaped structure. The inferior service plate 143 has a ring shape. The negative space that forms the characteristic ring structure of the inferior service plate 143 is geometrically similar to the storage stanchion 103. The negative space that forms the characteristic ring structure of the inferior service plate 143 is a disk shaped structure. The center axis of the negative space that forms the characteristic ring structure of the inferior service plate 143 aligns with the center axis of the storage stanchion 103 such that the open face of the pan structure of the storage stanchion 103 is accessible through the inferior service plate 143. The inferior service plate 143 further comprises a plurality of service spacers 144 and a plurality of stemware slots 145.

Each of the plurality of stemware slots 145 is a radial slot that is formed from the perimeter of the disk structure of the superior service plate 141 towards the center of the superior service plate 141. Each of the plurality of stemware slots 145 is sized to receive the stem of a glass such that the glass can be suspended from the superior service plate 141.

Each of the plurality of service spacers 144 is a prism shaped structure. The plurality of service spacers 144 forms an extension structure. Each of the plurality of service spacers 144 attaches the inferior face of the medial service plate 142 to the superior face of the inferior service plate 143 such that the plurality of service spacers 144 forms a space between the medial service plate 142 and the inferior service plate 143. The plurality of service spacers 144 positions the medial service plate 142 relative to the inferior service plate 143 such that the center axes of the medial service plate 142 and the inferior service plate 143 align. The plurality of service spacers 144 are positioned such that: a) the medial service plate 142 and the inferior service plate 143 attach to the lateral faces of the plurality of service spacers 144; and, b) that the center axes of the plurality of service spacers 144 project radially away from the aligned center axes of the medial service plate 142 and the inferior service plate 143.

In a second potential embodiment of the disclosure, the invention 100 further comprises a plurality of decorative LEDs 105 and a lid 106.

Each of the plurality of decorative LEDs 105 is a light emitting diode. Each of the plurality of decorative LEDs 105 is a decorative structure that illuminates one or more visible surfaces of the. Each of the plurality of decorative LEDs 105 mounts on a visible surface of a structure selected from the group consisting of: a) the storage stanchion 103; b) the superior service plate 141 of the service platform 104; and, c) the medial service plate 142 of the service platform 104.

The lid 106 is an insulating structure. The lid 106 is geometrically similar to the negative spaces that form the characteristic ring structure of the superior service plate 141. The lid 106 is geometrically similar to the negative spaces that form the characteristic ring structure of the medial service plate 142. The lid 106 is geometrically similar to the open face of the pan structure of the storage stanchion 103. The lid 106 inserts through the negative spaces of the superior service plate 141 and the medial service plate 142 to enclose the open face of the storage stanchion 103.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Application or App: As used in this disclosure, an application or app is a self-contained piece of software that is especially designed or downloaded for use with a personal data device.

Bluetooth™: As used in this disclosure, Bluetooth™ is a standardized communication protocol that is used to wirelessly interconnect electronic devices.

Cart: As used in this disclosure, a cart is small vehicle intended to be moved by a person. A synonym for cart is hand cart.

Caster: As used in this disclosure, a caster is a wheel that is mounted on a swivel that allows the wheel to adjust, or swivel, the direction of rotation of the wheel to the direction of motion desired for the wheel. The generic parts of a caster are called the stem, the swivel bearing, the swivel mount and the wheel. The swivel bearing attaches the stem to the swivel mount such that the swivel mount will rotate relative to the stem. The wheel attaches to the swivel mount such that the wheel freely rotates relative to the swivel mount. The direction of the axis of rotation of the wheel is perpendicular to the direction of the axis of rotation of the swivel mount. The stem attaches the swivel bearing, the swivel mount, and the wheel to an externally provided object.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Communication Link: As used in this disclosure, a communication link refers to the structured exchange of data between two objects.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Decorative: As used in this disclosure, decorative is an adjective that refers to a first object or item that is used with a second object or item of the purpose of making the second object or item more attractive. Decorative will generally, but not necessarily, implies making the second object or item more attractive visually.

Diameter: As used in this disclosure, a diameter of an object is a straight line segment (or a radial line) that passes through the center (or center axis) of an object. The line segment of the diameter is terminated at the perimeter or boundary of the object through which the line segment of the diameter runs. A radius refers to the line segment that overlays a diameter with one termination at the center of the object. A span of a radius is always one half the span of the diameter.

Diode: As used in this disclosure, a diode is a two terminal semiconductor device that allows current flow in only one direction. The two terminals are called the anode and the cathode. Electric current is allowed to pass from the anode to the cathode.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Electric Motor: In this disclosure, an electric motor is a machine that converts electric energy into rotational mechanical energy. An electric motor typically comprises a stator and a rotor. The stator is a stationary hollow cylindrical structure that forms a magnetic field. The rotor is a magnetically active rotating cylindrical structure that is coaxially mounted in the stator. The magnetic interactions between the rotor and the stator physically causes the rotor to rotate within the stator thereby generating rotational mechanical energy. This disclosure assumes that the power source is an externally provided source of DC electrical power. The use of DC power is not critical and AC power can be used by exchanging the DC electric motor with an AC motor that has a reversible starter winding.

Elevation: As used in this disclosure, elevation refers to the span of the distance in the superior direction between a specified horizontal surface and a reference horizontal surface. Unless the context of the disclosure suggest otherwise, the specified horizontal surface is the supporting surface the potential embodiment of the disclosure rests on. The infinitive form of elevation is to elevate.

Extension Apparatus: As used in this disclosure, an extension apparatus is a mechanical structure that is used to extend or bridge the reach between any two objects.

Extension Structure: As used in this disclosure, an extension structure is an inert physical structure that is used to extend or bridge the reach between any two objects.

Exterior: As used in this disclosure, the exterior is used as a relational term that implies that an object is not contained within the boundary of a structure or a space.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

GPS: As used in this disclosure, and depending on the context, GPS refers to: a) a system of navigational satellites that are used to determine the position, known as GPS coordinates, and velocity of a person or object; b) the system of navigational satellites referred to in the first definition that are used to synchronize to global time; or, c) an electronic device or that uses the system of navigational satellites referred to in the first definition to determine the position of a person or object. GPS is an acronym for Global Positioning System. Methods to determine the distance and direction between any two sets of GPS coordinates are well-known and documented in the navigational arts.

Hook: As used in this disclosure, a hook is an object that is curved or bent at an angle such that items can be hung on or caught by the object.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inferior: As used in this disclosure, the term inferior refers to a directional reference that is parallel to and in the same direction as the force of gravity when an object is positioned or used normally.

Inner Dimension: As used in this disclosure, the term inner dimension describes the span from a first inside or interior surface of a container to a second inside or interior surface of a container. The term is used in much the same way that a plumber would refer to the inner diameter of a pipe.

Insulating Material: As used in this disclosure, an insulating material is a material that inhibits, and ideally prevents, the transfer of heat through the insulating material. Insulating materials may also be used to inhibit or prevent the transfer of sound or the conduction of electricity through the insulating material. Methods to form insulating materials include, but are not limited to: a) the use of materials with low thermal conductivity; b) the use of materials with low electrical conductivity (or high resistivity); and, c) the use of a structural design that places a vacuum within the insulating material within the anticipated transfer path of the heat, sound, or electric current flow.

Insulating Structure (Heat): As used in this disclosure, an insulating structure is a structure that inhibits, and ideally prevents, the transfer of heat through the insulating structure. Insulating structures may also be used to inhibit or prevent the transfer of sound through the insulating structure. Methods to form insulating structures include, but are not limited to: 1) the use of materials with low thermal conductivity; and, 2) the use of a structural design that places a vacuum within the insulating structure within the anticipated transfer path of the heat or sound.

Interior: As used in this disclosure, the interior is used as a relational term that implies that an object is contained within the boundary of a structure or a space.

LED: As used in this disclosure, an LED is an acronym for a light emitting diode. A light emitting diode is a diode that is also a light source.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Logic Module: As used in this disclosure, a logic module is a readily and commercially available electrical device that accepts digital and analog inputs, processes the digital and analog inputs according to previously specified logical processes and provides the results of these previously specified logical processes as digital or analog outputs. The disclosure allows, but does not assume, that the logic module is programmable.

Loop: As used in this disclosure, a loop is the length of a first linear structure including, but not limited to, shafts, lines, cords, or webbings, that is: 1) folded over and joined at the ends forming an enclosed space; or, 2) curved to form a closed or nearly closed space within the first linear structure. In both cases, the space formed within the first linear structure is such that a second linear structure such as a line, cord or a hook can be inserted through the space formed within the first linear structure. Within this disclosure, the first linear structure is said to be looped around the second linear structure.

Mechanical Linkage: As used in this disclosure, a mechanical linkage is an interconnected arrangement of components that are used to manage the transfer of a movement or a force. A mechanical linkage is often referred to as a linkage.

Motor: As used in this disclosure, a motor refers to the method of transferring energy from an external power source into rotational mechanical energy.

Negative Space: As used in this disclosure, negative space is a method of defining an object through the use of open or empty space as the definition of the object itself, or, through the use of open or empty space to describe the boundaries of an object.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Outer Dimension: As used in this disclosure, the term outer dimension describes the span from a first exterior or outer surface of a tube or container to a second exterior or outer surface of a tube or container. The term is used in much the same way that a plumber would refer to the outer diameter of a pipe.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan are open.

PDD: As used in this disclosure, PDD is an acronym for personal data device.

Perimeter: As used in this disclosure, a perimeter is one or more curved or straight lines that bounds an enclosed area on a plane or surface. The perimeter of a circle is commonly referred to as a circumference.

Personal Data Device: As used in this disclosure, a personal data device is a handheld logical device that is used for managing personal information and communication. Examples of personal data device include, but are not limited to, cellular phones, tablets, and smartphones.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Radial: As used in this disclosure, the term radial refers to a direction that: 1) is perpendicular to an identified central axis; or, 2) projects away from a center point.

Reach: As used in this disclosure, reach refers to a span of distance between any two objects.

Recess: As used in this disclosure, a recess is a disk-shaped negative space that is formed in a surface. The recess forms a pan shaped. The recess is sized to receive an object such that a portion of the object is below the plane of the surface in which the recess is formed.

Ring: As used in this disclosure, a ring is term that is used to describe a disk-like structure through which a negative space is formed through the faces of the disk-like structure. Rings are often considered loops.

Stanchion: As used in this disclosure, a stanchion refers to a vertically oriented prism-shaped pole, post, or support.

Such As: As used in this disclosure, the term "such as" is a conjunction that relates a first phrase to a subsequent phrase. The term "such as" is used to introduce representative examples of structures that meet the requirements of the first phrase. As a first example of the use of the term "such as," the phrase: "the first textile attaches to the second textile using a fastener such as a hook and loop fastener" is taken to mean that a hook and loop fastener is suitable to use as the fastener but is not meant to exclude the use of a zipper or a sewn seam. As a second example of the use of the term "such as," the phrase: "the chemical substance is a halogen such as chlorine or bromine" is taken to mean that either chlorine or bromine are suitable for use as the halogen but is not meant to exclude the use of fluorine or iodine.

Such That: As used in this disclosure, the term "such that" is a conjunction that relates a first phrase to a subsequent phrase. The term "such that" is used to place a further limitation or requirement to the first phrase. As a first example of the use of the term "such that," the phrase: "the door attaches to the wall such that the door rotates relative to the wall" requires that the attachment of the door allows for this rotation. As a second example of the use of the term "such that," the phrase: "the chemical substance is selected such that the chemical substance is soluble in water" requires that the selected chemical substance is soluble in water. As a third example of the use of the term "such that," the phrase: "the lamp circuit is constructed such that the lamp circuit illuminates when the lamp circuit detects darkness" requires that the lamp circuit: a) detect the darkness; and, b) generate the illumination when the darkness is detected.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load of the object is transferred. This disclosure assumes that an object placed on the supporting surface is in an orientation that is appropriate for the normal or anticipated use of the object.

Swivel: As used in this disclosure, a swivel is a fastening structure that attaches a first object to a second object such that will rotate around an axis of rotation while the second object remains in a fixed position relative to the first object.

Vehicle: As used in this disclosure, a vehicle is a device that is used for transporting passengers, goods, or equipment. The term motorized vehicle specifically refers to a vehicle can move under power provided by an electric motor or an internal combustion engine. The term vehicle generically applies to motorized vehicles and vehicles without a motor. A motorized vehicle further comprises an electrical system that can be used as a source of electric energy. The enclosed passenger space of a vehicle is known as a cab.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

Wheel: As used in this disclosure, a wheel is a circular object that revolves around an axle or an axis and is fixed below an object to enable it to move easily over the ground. For the purpose of this disclosure, it is assumed that a wheel can only revolve in a forward and a backward direction. Wheels are often further defined with a rim and spokes. Spokes are also commonly referred to as a wheel disk.

WiFi™: As used in this disclosure, WiFi™ refers to the physical implementation of a collection of wireless electronic communication standards commonly referred to as IEEE 802.11x.

Wireless: As used in this disclosure, wireless is an adjective that is used to describe a communication link between two devices that does not require the use of physical cabling.

Wireless Communication Establishment Technology: As used in this disclosure, a wireless communication establishment technology refers to technology that establishes a wireless communication link between a first logical device and a second logical device. Usually, the operation of a wireless communication establishment technology is initiated by the push of a button. An example of such a technology is the WiFi™ protected setup technology (WPS™)

Worm Drive: As used in this disclosure, a worm drive refers to a mechanical arrangement where a rotating cylinder further comprising an exterior screw thread is used to: 1) rotate a gear; or 2) move a plate formed with an interior screw thread in a linear fashion in the direction of the center axis of the rotating cylinder. Worm drives are also referred to as worm gears.

With respect to the above description, it is to be realized that the optimum dimensional relationship for the various components of the invention described above and in FIGS. 1 through 3 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A combined ice chest and bar top comprising a pedestal structure, a storage platform, a storage stanchion, and a service platform;

wherein the storage platform attaches the pedestal structure to the storage stanchion;

wherein the storage stanchion attaches the service platform to the storage platform;

wherein the combined ice chest and bar top is a cart;

wherein the combined ice chest and bar top forms a temporary station;

wherein the service platform comprises a superior service plate, a medial service plate, and an inferior service plate;

wherein the superior surface of the medial service plate mounts directly onto the inferior surface of the superior service plate;

wherein the plurality of service spacers forms an extension structure;

wherein each of the plurality of service spacers attaches the medial service plate to the inferior service plate such that the plurality of service spacers forms a space between the medial service plate and the inferior service plate.

2. The combined ice chest and bar top according to claim 1 wherein the pedestal structure forms the cart structure that allows the combined ice chest and bar top to be rolled into position; wherein the pedestal structure further adjusts the elevation of the storage platform, the storage stanchion, and the service platform relative to a supporting surface; wherein the pedestal structure has a composite structure; wherein the pedestal structure forms a load path that transfers the load of the combined ice chest and bar top to a supporting surfaces; wherein the pedestal structure is a rolling structure.

3. The combined ice chest and bar top according to claim 2 wherein the pedestal structure is an extension device;

wherein the pedestal structure is an adjustable structure such that a vertical reach of the pedestal structure is adjustable such that the elevations of the storage platform, the storage stanchion, and the service platform relative to the supporting surface.

4. The combined ice chest and bar top according to claim 3 wherein the storage platform has a composite structure;

wherein the storage platform forms a storage structure;

wherein the superior pedestal plate of the pedestal structure attaches to the storage platform to form a composite structure.

5. The combined ice chest and bar top according to claim 4 wherein the storage stanchion inserts into the superior congruent end of the storage platform to form a composite structure;

wherein the storage stanchion has a pan shape;

wherein the storage stanchion forms a hollow interior used to store ice;

wherein the storage stanchion is an insulating structure;

wherein the open face of the pan structure of the storage stanchion forms the superior surface of the storage stanchion.

6. The combined ice chest and bar top according to claim 5 wherein the service platform has a composite structure;

wherein the service platform attaches to the open face of the pan structure of the storage stanchion to form the composite structure.

7. The combined ice chest and bar top according to claim 6 wherein the pedestal structure comprises a superior pedestal plate, an inferior pedestal plate, a worm drive, and a control circuit;

wherein the worm drive is a mechanical device that attaches the superior pedestal plate to the inferior pedestal plate.

8. The combined ice chest and bar top according to claim 7 wherein the storage platform comprises a superior storage plate, an inferior storage plate, and a plurality of storage spacers;

wherein the plurality of storage spacers forms an extension structure;

wherein each of the plurality of storage spacers attaches the superior storage plate to the inferior storage plate such that the plurality of storage spacers forms a space between the superior storage plate and the inferior storage plate.

9. The combined ice chest and bar top according to claim 8 wherein the superior pedestal plate is a disk shaped structure;

wherein the superior pedestal plate forms the superior structure of the pedestal structure;

wherein the inferior pedestal plate is a disk shaped structure;

wherein the inferior pedestal plate forms the load path of the structure that transfers the load of the combined ice chest and bar top from the worm drive to the plurality of casters;

wherein the worm drive attaches the superior pedestal plate to the inferior pedestal plate such that the faces of the disk structures of the superior pedestal plate and the inferior pedestal plate are parallel to each other;

wherein the worm drive attaches the superior pedestal plate to the inferior pedestal plate to form a composite structure;

wherein the worm drive is an adjustable structure;

wherein by adjustable is meant that the vertical reach of the worm drive is adjustable such that the reach between the superior pedestal plate and the inferior pedestal plate is adjustable.

10. The combined ice chest and bar top according to claim 9 wherein the control circuit is an electric circuit;

wherein the control circuit controls the operation of the worm drive;

wherein the control circuit provides the motive forces necessary to power the worm drive;

wherein the control circuit comprises a logic module, a communication module, an electric motor, and a personal data device;

wherein the logic module, the communication module, and the electric motor are electrically interconnected connected;

wherein the communication module further comprises a wireless communication link;

wherein the communication module forms the wireless communication link with the personal data device.

11. The combined ice chest and bar top according to claim 10 wherein the logic module controls the operation of the electric motor;

wherein the electric motor is an electromechanical device;

wherein the electric motor converts electrical energy into rotational mechanical energy;

wherein the electric motor forms a mechanical linkage with the worm drive of the pedestal structure such that the rotation of the electric motor provides the motive forces required for the operation of the worm drive;

wherein the logic module controls the operation of the electric motor;

wherein by controlling the operation of the logic module is meant that the logic module controls the direction of rotation of the electric motor;

wherein by controlling the operation of the logic module is further meant that the logic module controls the speed of rotation of the electric motor.

12. The combined ice chest and bar top according to claim 11 wherein the superior storage plate is a disk shaped structure;

wherein the superior storage plate has a ring shape;

wherein the superior storage plate forms the superior structure of the storage platform;

wherein the inner diameter of the negative space that forms the characteristic ring structure of the of the superior storage plate is sized such that the storage stanchion inserts through the superior storage plate to rest on the superior surface of the inferior storage plate;

wherein the inferior storage plate is a disk shaped structure;

wherein the superior end of the worm drive of the pedestal structure attaches to the disk structure of the inferior storage plate such that the vertical movement of the worm drive changes the elevation of the inferior storage plate;

wherein the closed end of the pan structure of the storage stanchion inserts through the negative space that forms the characteristic ring structure of the superior storage plate and the plurality of storage spacers to rest on the superior surface of the inferior storage plate;

wherein the plurality of storage spacers positions the superior storage plate relative to the inferior storage plate such that the center axes of the superior storage plate and the inferior storage plate align;

wherein the plurality of storage spacers are positioned such that: a) the superior storage plate and the inferior storage plate attach to the lateral faces of the plurality of storage spacers; and, b) that the center axes of the plurality of storage spacers project radially away from the aligned center axes of the superior storage plate and the inferior storage plate.

13. The combined ice chest and bar top according to claim 12 wherein the superior service plate is a disk shaped structure;

wherein the superior service plate has a ring shape;

wherein the negative space that forms the characteristic ring structure of the superior service plate is geometrically similar to the storage stanchion;

wherein the negative space that forms the characteristic ring structure of the superior service plate is a disk shaped structure;

wherein the center axis of the negative space that forms the characteristic ring structure of the of the superior service plate aligns with the center axis of the storage stanchion such that the open face of the pan structure of the storage stanchion is accessible through the superior service plate;

wherein the medial service plate of the medial service plate is a disk shaped structure;

wherein the medial service plate has a ring shape;

wherein the inner diameter of the negative space that forms the characteristic ring structure of the medial service plate is sized such that the storage stanchion inserts through the medial service plate to reach the superior service plate;

wherein the medial service plate mounts on the superior service plate such that the center axes of the medial service plate and the superior service plate align;

wherein the medial service plate mounts on the superior service plate such that the center axis of the negative space that forms the characteristic ring structure of the of the medial service plate aligns with the center axis of the negative space that forms the characteristic ring structure of the of the inferior service plate is a disk shaped structure;

wherein the inferior service plate is a disk shaped structure;

wherein the inferior service plate has a ring shape;

wherein the negative space that forms the characteristic ring structure of the inferior service plate is geometrically similar to the storage stanchion;

wherein the negative space that forms the characteristic ring structure of the inferior service plate is a disk shaped structure;

wherein the center axis of the negative space that forms the characteristic ring structure of the inferior service plate aligns with the center axis of the storage stanchion such that the open face of the pan structure of the storage stanchion is accessible through the inferior service plate;

wherein the plurality of service spacers positions the medial service plate relative to the inferior service plate such that the center axes of the medial service plate and the inferior service plate align;

wherein the plurality of service spacers are positioned such that: a) the medial service plate and the inferior service plate attach to the lateral faces of the plurality of service spacers; and, b) that the center axes of the plurality of service spacers project radially away from the aligned center axes of the medial service plate and the inferior service plate.

* * * * *